US011525300B1

(12) United States Patent
Huang et al.

(10) Patent No.: US 11,525,300 B1
(45) Date of Patent: Dec. 13, 2022

(54) CORD WINDING ASSEMBLY WITH TILT MEMBERS AND WINDOW BLIND USING THE CORD WINDING ASSEMBLY

(71) Applicant: CHING FENG HOME FASHIONS CO., LTD., Fuxing Township, Changhua County (TW)

(72) Inventors: Chien-Chih Huang, Fuxing Township (TW); Wei-Ming Shih, Fuxing Township (TW)

(73) Assignee: CHING FENG HOME FASHIONS CO., LTD., Chang-Hua (TW)

( * ) Notice: Subject to any disclaimer, the term of this patent is extended or adjusted under 35 U.S.C. 154(b) by 0 days.

(21) Appl. No.: 17/500,431

(22) Filed: Oct. 13, 2021

(30) Foreign Application Priority Data

Sep. 10, 2021 (TW) ..... 110133760

(51) Int. Cl.
*E06B 9/322* (2006.01)

(52) U.S. Cl.
CPC ..... *E06B 9/322* (2013.01); *E06B 2009/3225* (2013.01)

(58) Field of Classification Search
CPC . E06B 9/322; E06B 9/32; E06B 9/307; E06B 9/308; E06B 9/303; E06B 9/304; E06B 9/305; E06B 9/306; E06B 2009/3225
See application file for complete search history.

(56) References Cited

U.S. PATENT DOCUMENTS 3,090,428 A * 5/1963 Lidin ..... E06B 9/308 160/168.1 R
3,269,453 A * 8/1966 Vecchiarelli ..... E06B 9/322 160/176.1 R
4,494,593 A * 1/1985 Fielder, Jr. ..... E06B 9/307 160/177 R
4,697,630 A * 10/1987 Rude ..... E06B 9/307 160/176.1 R
4,821,789 A * 4/1989 Van Rens ..... E06B 9/307 160/176.1 R
D329,350 S * 9/1992 Jian ..... E06B 9/308 D6/580
5,228,491 A * 7/1993 Rude ..... E06B 9/307 160/171
5,328,113 A * 7/1994 de Chevron Villette ..... E06B 9/308 242/388

(Continued)

FOREIGN PATENT DOCUMENTS

CN 201452781 U * 5/2010
CN 102764059 A * 11/2012

(Continued)

*Primary Examiner* — Johnnie A. Shablack
(74) *Attorney, Agent, or Firm* — Birch, Stewart, Kolasch & Birch, LLP

(57) ABSTRACT

A window blind includes a headrail, a controller, a rotating rod, a pivoting member, a blind body, a bottom rail, two lift cord sets, two tilt cord sets and two cord winding assemblies. With the technical feature that the rotating rod and the tilt members of the cord winding assemblies are arranged in the same axial direction in sequence, the effect of almost synchronous rotation can be achieved, thereby optimizing the complexity of the overall blind window components or related parts.

8 Claims, 13 Drawing Sheets

(56) References Cited

U.S. PATENT DOCUMENTS 5,341,865 A * 8/1994 Fraser ..... E06B 9/307 160/176.1 R
5,497,820 A * 3/1996 Drake, III ..... E06B 9/307 74/504
5,638,882 A * 6/1997 Morris ..... E06B 9/308 160/176.1 R
5,921,306 A * 7/1999 Smederod ..... E06B 9/307 160/177 R
6,302,182 B1 * 10/2001 Anderson ..... E06B 9/322 160/177 R
6,321,820 B1 * 11/2001 Liu ..... E06B 9/303 160/178.1 R
6,588,480 B2 * 7/2003 Anderson ..... E06B 9/322 160/170
6,745,812 B1 * 6/2004 Liu ..... E06B 9/322 160/177 R
6,845,802 B1 * 1/2005 Anderson ..... E06B 9/322 160/115
6,915,831 B2 * 7/2005 Anderson ..... E06B 9/322 242/366
6,918,424 B2 * 7/2005 Lin ..... E06B 9/322 160/171
6,976,522 B2 * 12/2005 Strand ..... E06B 9/308 160/176.1 R
7,096,918 B2 * 8/2006 Lin ..... E06B 9/322 160/171
7,137,430 B2 * 11/2006 Fraczek ..... E06B 9/308 160/170
7,159,635 B2 * 1/2007 Holt ..... E06B 9/322 160/84.05
7,178,577 B2 * 2/2007 Liu ..... E06B 9/32 160/170
7,210,646 B2 * 5/2007 Hsu ..... E06B 9/322 242/615.3
7,287,569 B2 * 10/2007 Lin ..... E06B 9/303 160/176.1 R
7,367,377 B2 * 5/2008 Lin ..... E06B 9/322 160/171
7,370,683 B2 * 5/2008 Numajiri ..... E06B 9/322 160/170
7,389,956 B2 * 6/2008 Hung ..... E06B 9/322 160/170
7,520,311 B2 * 4/2009 Drew ..... E06B 9/64 160/171
7,540,315 B2 * 6/2009 Chen ..... E06B 9/322 242/395
7,654,300 B2 * 2/2010 Chigusa ..... E06B 9/322 160/300
7,665,503 B2 * 2/2010 Liu ..... E06B 9/382 160/176.1 R
7,913,738 B2 * 3/2011 Fraser ..... E06B 9/307 160/176.1 R
7,921,897 B2 * 4/2011 Chou ..... E06B 9/307 160/176.1 R
8,025,089 B2 * 9/2011 Chelednik ..... E06B 9/322 160/171
8,267,145 B2 * 9/2012 Fraser ..... E06B 9/307 160/115
8,281,843 B2 * 10/2012 Yu ..... E06B 9/322 160/176.1 R
8,820,385 B2 * 9/2014 Wu ..... E06B 9/322 160/170
8,960,258 B2 * 2/2015 Hendriks ..... E06B 9/326 160/170
9,045,934 B1 * 6/2015 Lynch ..... E06B 9/322
9,078,537 B2 * 7/2015 Lee ..... A47H 5/032
9,091,115 B2 * 7/2015 Mullet ..... E06B 9/322
9,157,273 B2 * 10/2015 Dekker ..... E06B 9/322
9,371,687 B2 * 6/2016 Yu ..... E06B 9/262
9,487,996 B2 * 11/2016 Steenbergen ..... E06B 9/307
10,501,986 B2 * 12/2019 Cheng ..... B65H 75/4471
10,626,667 B2 * 4/2020 Schulman ..... E06B 9/326
10,655,384 B2 * 5/2020 Foley ..... E06B 9/322
10,724,294 B2 * 7/2020 Guerra ..... E06B 9/322
10,781,631 B2 * 9/2020 Huang ..... E06B 9/68
11,142,944 B2 * 10/2021 Jackson ..... E06B 9/78
11,339,607 B2 * 5/2022 Cheng ..... E06B 9/262
2004/0144501 A1 * 7/2004 Oskam ..... E06B 9/322 160/173 R
2004/0163774 A1 * 8/2004 Nien ..... E06B 9/307 160/168.1 P
2007/0029051 A1 * 2/2007 Nien ..... E06B 9/322 160/84.05
2008/0083512 A1 * 4/2008 Hsu ..... E06B 9/322 160/170
2009/0108116 A1 * 4/2009 Chang ..... E06B 9/322 242/388
2009/0256021 A1 * 10/2009 Dorrough ..... E06B 9/322 242/397
2010/0270457 A1 * 10/2010 Ko ..... E06B 9/322 248/674
2011/0253321 A1 * 10/2011 Yu ..... E06B 9/322 160/332
2012/0073765 A1 * 3/2012 Hontz ..... E06B 9/304 160/331
2015/0144275 A1 * 5/2015 Ganzi ..... E06B 9/32 160/84.03
2016/0208551 A1 * 7/2016 Huang ..... E06B 9/56
2017/0298687 A1 * 10/2017 Chen ..... E06B 9/322
2018/0347269 A1 * 12/2018 Wang ..... E06B 9/30
2020/0355025 A1 * 11/2020 He ..... E06B 9/322
2021/0189798 A1 * 6/2021 Nien ..... E06B 9/322

FOREIGN PATENT DOCUMENTS

CN 105041173 A 11/2015
TW M356795 U 5/2009
WO WO 2014/019481 A1 2/2014
WO WO 2015/074446 A1 5/2015

* cited by examiner

CORD WINDING ASSEMBLY WITH TILT MEMBERS AND WINDOW BLIND USING THE CORD WINDING ASSEMBLY

BACKGROUND OF THE INVENTION

1. Field of the Invention

The present invention relates to window blind winding technology and more particularly, to a cord winding assembly with tilt members and a window blind using the cord winding assembly.

2. Description of the Related Art

At present, there are many kinds of cord winding assemblies used on window blinds, and their purpose is to facilitate users to adjust indoor lighting, ventilation or concealment, etc. However, when the slats of the window blind are to be folded or extended, the slats need to be turned before they can be folded or extended. As a result, it is really inconvenient to operate, and it will also increase the complexity of the overall window blind components or related parts.

SUMMARY OF THE INVENTION

The present invention has been accomplished under the circumstances in view. It is the main object of the present invention to provide a window blind, which comprises two cord winding assemblies. With the technical feature that the rotating rod and the tilt members of the cord winding assemblies are arranged in the same axial direction in sequence, the effect of almost synchronous rotation can be achieved, thereby optimizing the complexity of the overall blind window components or related parts. The window blind disclosed by the present invention comprises a headrail, a controller, a rotating rod, a pivoting member, a blind body, a bottom rail, two lift cord sets, two tilt cord sets and two cord winding assemblies. The controller is installed on one side of the headrail. The rotating rod, the pivoting member and the two cord winding assemblies are all set on the headrail. The controller is electrically connected to a micro-control unit of the pivoting member, so that the pivoting member is electrically controlled by the micro-control unit. The rotating rod has one end thereof connected to the pivoting member and pivoted by the pivoting member to produce movement, and an opposite end thereof passed through the rotating members and the tilt members of the two cord winding assemblies. The blind body comprises a plurality of slats. The blind body has one side thereof connected to the headrail, and an opposite side thereof connected to the bottom rail. The lift cord sets have respective one ends thereof respectively set on the rotating members of the cord winding assemblies, and respective opposite ends thereof respectively inserted through a respective perforation of the headrail and connected with the slats of the blind body and then fixed to the bottom rail. The tilt cord sets have respective one ends thereof respectively tied to the tilt members of the cord winding assemblies, and respective opposite ends thereof respectively inserted through the respective perforations of the headrail and connected with the slats of the blind body and then fixed to the bottom rail. Each cord winding assembly comprises a base, two rotating members, and a tilt member. The base comprises a first accommodating portion, a second accommodating portion and a third accommodating portion. The first accommodating portion has a cord hole penetrated through the bottom thereof. The second accommodating portion has a cord hole penetrated through the bottom thereof. The third accommodating portion has a tilt cord hole penetrated through the bottom thereof and is provided with a protrusion. The second accommodating portion is located between the first accommodating portion and the third accommodating portion. Each rotating member is a hollow tube body and forms an outer peripheral wall and an inner peripheral wall. The outer peripheral wall of each rotating member comprises a large-diameter end, a wire guide section and a small-diameter end. The large-diameter end and the small-diameter end of each rotating member are respectively pivoted on the first accommodating portion and the second accommodating portion of the base. The wire guide section surrounds the outer peripheral wall of the rotating member and is connected to the large-diameter end. The wire guide section converges from the large-diameter end to the small-diameter end. The outer peripheral wall of each rotating member is recessed in the direction of the inner peripheral wall to form a guide sliding portion that communicates with the outside world. Each rotating member is provided with a guide slider. The guide slider is pivotally set on the associating guide sliding portion. The tilt member is pivotally connected to the third accommodating portion of the base. The two retaining walls of the small-diameter end of the tilt member are blocked by the protrusion of the third accommodating portion of the base after a predetermined pivot.

In summary, in this way, with the technical feature that the rotating rod and the rotating members and the tilt members of the cord winding assemblies are arranged in the same axial direction in sequence, the effect of almost synchronous rotation can be achieved, thereby optimizing the complexity of the overall blind window components or related parts.

DETAILED DESCRIPTION OF THE INVENTION

Figure 1:
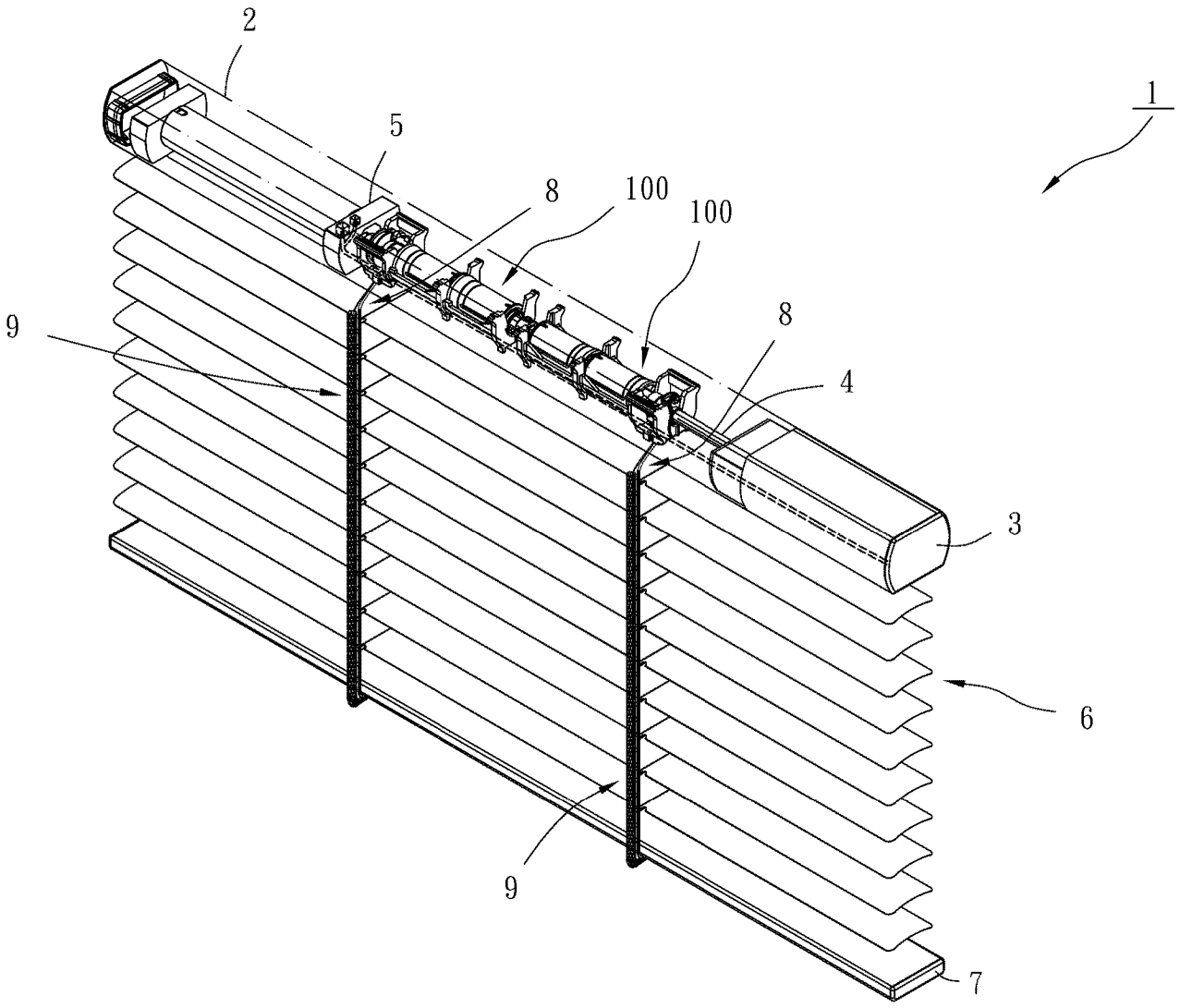
FIG. 1 is an oblique top elevational view of a window blind in an unfolded state in accordance with the present invention.
Figure 2:
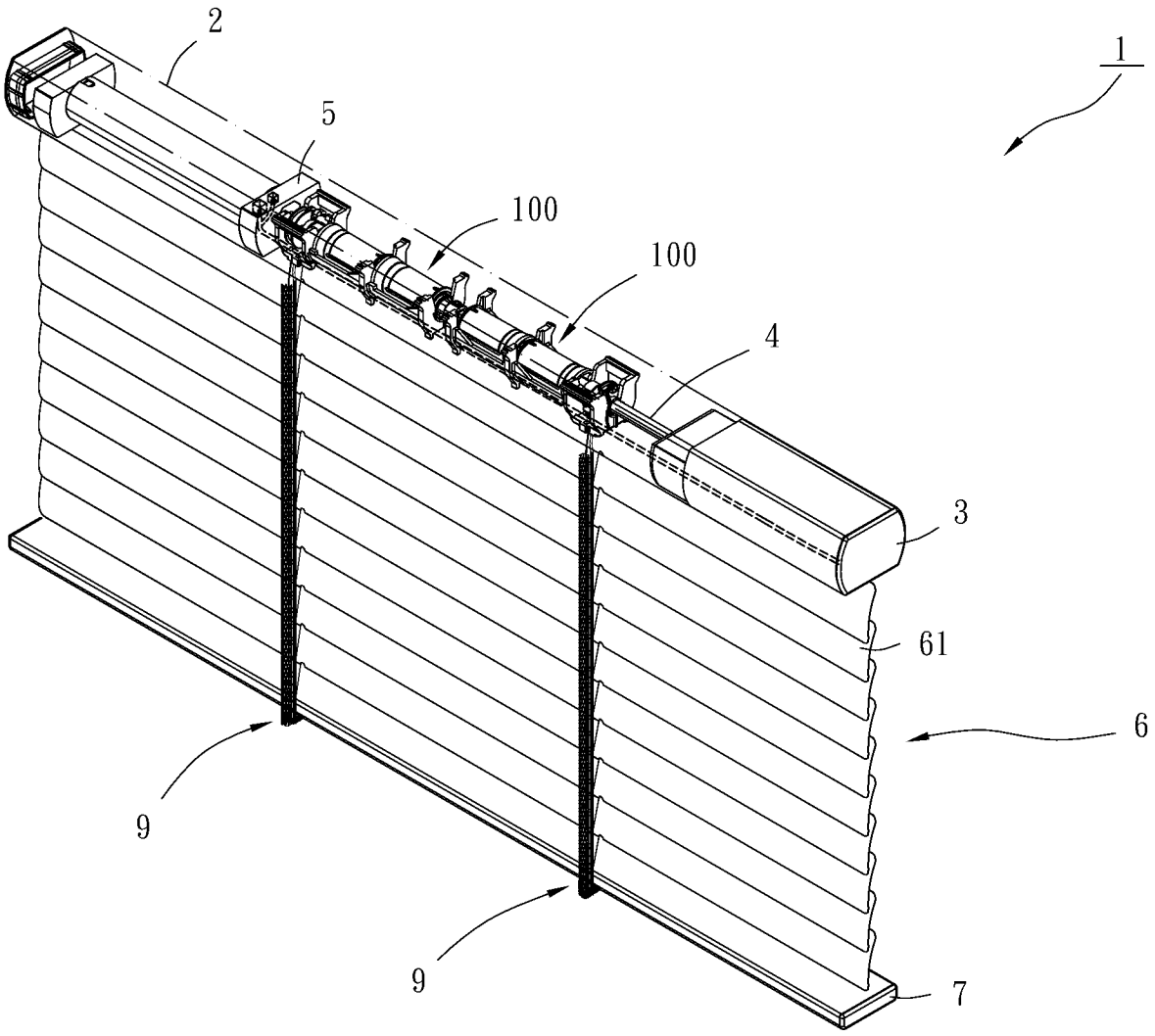
FIG. 2 is similar to FIG. 1, which mainly reveals that the slats of the blind body of the window blind tilted.
Figure 3:
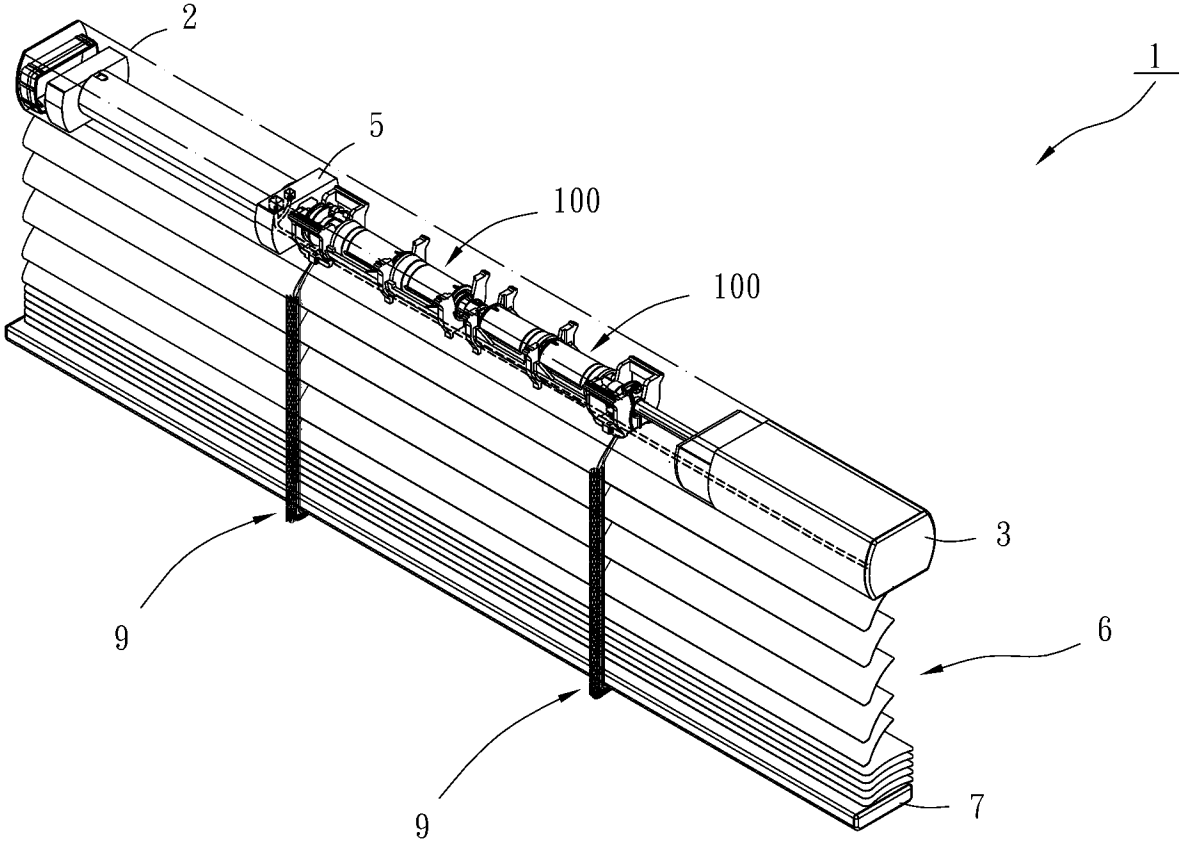
FIG. 3 is similar to FIG. 2, which mainly reveals that the slats of the blind body of the window blind tilted present a state of being turned and folded at the same time.
Figure 4:
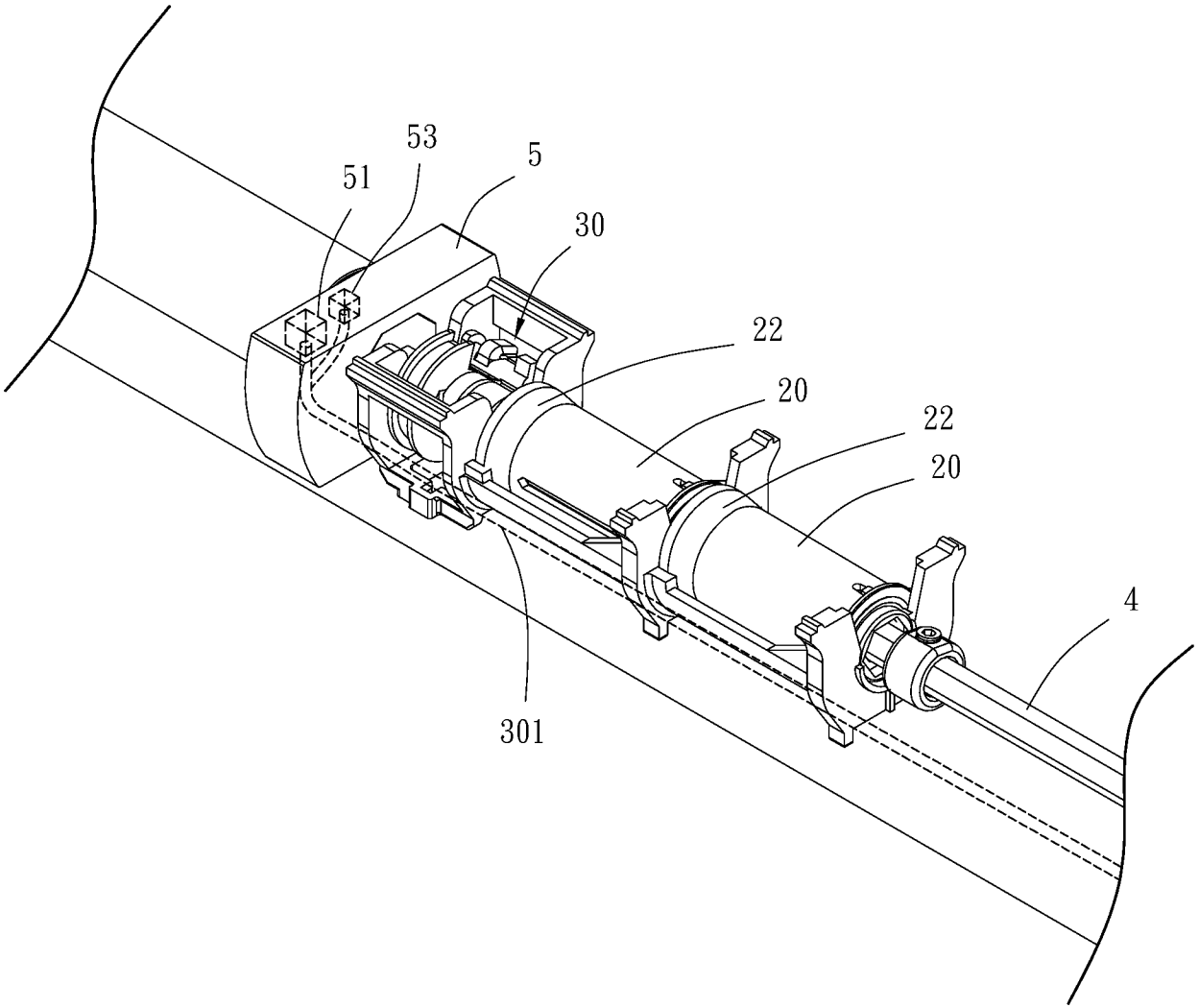
FIG. 4 is an enlarged and three-dimensional schematic diagram of part of the components of FIG. 1, which mainly reveals the relative relationship between a micro-control unit and a turning control unit of the window blind.

The applicant first states here that throughout the specification, including the preferred embodiment described below and the claims in the scope of patent application, the terms related to directionality are based on the directions in the drawings. Secondly, in the preferred embodiment and drawings to be described below, the same element numbers represent the same or similar elements or their structural features. Moreover, the detailed structure, characteristics, assembly or use, manufacturing and other methods of the present invention will be described in the detailed description of the subsequent embodiments. However, those with ordinary knowledge in the field of the present invention should be able to understand that these detailed descriptions and the examples listed in the present invention are only used to support the explanation that the present invention can actually be implemented, and are not intended to limit the patent scope of the present invention.

Referring to FIGS. 1-5, a window blind 1 provided by the preferred embodiment of the present invention comprises a headrail 2, a controller 3 (for example, the controller 3 contains an internal power supply unit), a rotating rod 4, a pivoting member 5, a blind body 6 composed of plural slats 61, a bottom rail 7, two lift cord sets 8, two tilt cord sets 9, and two cord winding assemblies 100.

The controller 3 is installed on one side of the headrail 2. The rotating rod 4, the pivoting member 5 and the two cord winding assemblies 100 are all contained in the headrail 2. The controller 3 is respectively and electrically connected to a micro-control unit 51 and a turning control unit 53 in the pivoting member 5 by a wire 301 in parallel, and the pivoting member 5 is electrically controlled by the micro-control unit 51 to generate a pivoting movement. One end of the rotating rod 4 is connected to the pivoting member 5 and is pivoted by the pivoting member 5 to produce movement. The other end of the rotating rod 4 is sequentially threaded through the two rotating members 20 of the two cord winding assemblies 100 in the form of a hollow tube, so that the two rotating members 20 of the two cord winding assemblies 100 are driven by the rotation of the pivoting member 5 to drive the rotating rod 4 to rotate accordingly. One side of the blind body 6 is connected to the bottom of the headrail 2, and the bottom rail 7 is connected to the other side of the blind body 6, so that the blind body 6 is between the headrail 2 and the bottom rail 7. One end of each of the two lift cord sets 8 is respectively connected to the two cord winding assemblies 100 and is rotated by the two cord winding assemblies 100. The other ends of the two lift cord sets 8 are respectively pierced through two perforations 200 of the headrail 2 and connected to the plural slats 61 of the blind body 6 and then fixed on the bottom rail 7 so that the slats 61 of the blind body 6 and the bottom rail 7 can be rotated by the two cord winding assemblies 100 and then show a state of folding or unfolding. One end of each of the two tilt cord sets 9 is respectively tied to the two cord winding assemblies 100 and is turned over by the rotation of the two cord winding assemblies 100. The other ends of the two tilt cord sets 9 are fixed to the bottom rail 7 after passing through the two perforation 200 of the headrail 2 and connected to the plural slats 61 of the blind body 6, so that the plural slats 61 of the blind body 6 can be rotated by the two cord winding assemblies 100 and then exhibit a clockwise or counterclockwise flip motion state.

Please refer to FIG. 4 to FIG. 11 together, each cord winding assembly 100 comprises an elongated base 10, two rotating members 20 that cooperate with the base 10 to be an elongated hollow tube, and a tilt member 30 that is wound in a hollow. The base 10 is recessed with a first accommodating portion 11 with an upward opening, a second accommodating portion 13 with an upward opening, and a third accommodating portion 15 with an upward opening. The bottom of the first accommodating portion 11 is pierced with a cord hole 111. The bottom of the second accommodating portion 13 is pierced with a cord hole 131. The bottom of the third accommodating portion 15 is provided with a tilt cord hole 151 and a protrusion 153. The second accommodating portion 13 is between the first accommodating portion 11 and the third accommodating portion 15. Preferably, the tilt cord holes 151 of the third accommodating portions 15 of the two bases 10 respectively correspond to the positions of the two perforations 200 of the headrail 2. The cord holes 111 of the first accommodating portions 11 of the two bases 10 are each provided with a metal rope guide ring 113 with a ring-shaped corner portion to reduce the friction between the rope and the member. The cord holes 131 of the second accommodating portions 13 of the two bases 10 are each provided with a metal rope guide ring 133 with a ring-shaped guide corner to reduce the friction generated between the rope and the member.

Any of the rotating members 20 is a long hollow tube and forms an outer peripheral wall 201 and an inner peripheral wall 203. The rotating member 20 comprises a large-diameter end 21, a wire guide section 22, a small-diameter end 23, a guide sliding portion 25, and a guide slider 27. The two rotating members 20 are respectively pivoted at the first accommodating portion 11 and the second accommodating portion 13 of the base 10 by the large-diameter end 21 and the small-diameter end 23. The large-diameter end 21 of any rotating member 20 is set toward the third accommodating portion 15 of the base 10. The wire guide section 22 of the rotating member 20 is wrapped around the outer peripheral wall 201 and connected to the large-diameter end 21, so that the wire guide section 22 gradually converges from the large-diameter end 21 to the small-diameter end 23. The guide sliding portion 25 of any rotating member 20 is formed by being recessed from the outer peripheral wall 201 of the rotating member 20 toward the inner peripheral wall 203, and the guide sliding portion 25 is recessed along the long axis of the rotating member 20 and can communicate with the outside. The guide sliding portion 25 is recessed along the long axis of the rotating member 20 and can communicate with the outside. The guide slider 27 of any rotating member 20 is pivoted on the guide sliding portion 25, so that the guide slider 27 can be moved back and forth along the long axis of the rotating member 20. The tilt member 30 is a hollow wound flexible member and forms an outer peripheral wall 301 and an inner peripheral wall 302 opposite to the outer peripheral wall 301, so that the opposite two ends of the tilt member 30 respectively form a large-diameter end 31 and a small-diameter end 33, and are pivoted to the third accommodating portion 15 of the base 10 by the large-diameter end 31 and the small-diameter end 33. The large-diameter end 31 of the tilt member 30 has a semi-circular cord guide portion 311, two cord-tying portions 313 arranged at intervals, and a groove 312 recessed radially from the outer periphery of the cord guide portion 311 toward the inner peripheral wall 302. Any cord-tying portion 313 is composed of a connecting section 3131 connected to a limiting section 3133, so that a locking section 3135 is formed between the connecting section 3131 and the limiting section 3133. The outer periphery of the small-diameter end 33 of the tilt member 30 has two radially protruding and spaced retaining walls 333.

The above are the technical features of the two cord winding assemblies 100 and their respective components of the window blind 1 disclosed in the preferred embodiment of the present invention. In the follow-up, we will continue to reveal the operation mode of the two cord winding assemblies 100 set on the window blind 1 and the desired effect:

First of all, please refer to FIG. 1 to FIG. 4 together, and let the two cord winding assemblies 100 be arranged in the headrail 2 at intervals, so that the first accommodating portions 11 of the two bases 10 of the two cord winding assemblies 100 are arranged relative to each other, and the tilt cord holes 151 of the third accommodating portions 15 of the two bases 10 of the two cord winding assemblies 100 respectively correspond to the positions of the two perforations 200 of the headrail 2. Then, let the other end of the rotating rod 4 pass through the rotating members 20 of the two cord winding assemblies 100 and the tilt members 30 of the hollow winding in sequence, so that the rotating members 20 and the tilt members 30 of the cord winding assemblies 100 can be rotated by the pivoting member 5, and indirectly, the rotating rod 4 can drive the rotating members 20 and the tilt members 30 of the two cord winding assemblies 100 to rotate therewith. In this way, by virtue of the technical features of rotating rod 4 that traverse the rotating members 20 and the tilt members 30 sequentially in the same axis, the rotating members 20 and the tilt members 30 can be rotated almost synchronously.

Then, please refer to FIG. 1 to FIG. 11 together. Any of the two lift cord sets 8 is composed of two lift cords 81. Let the respective one ends of the two lift cords 81 pass through the metal rope guide ring 113 of the cord hole 111 of the first accommodating portion 11 of the base 10 and the metal rope guide ring 133 of the cord hole 131 of the second accommodating portion 13 respectively, then wrap at least one turn on the outer peripheral walls 201 of the two rotating members 20 to form a respective reserved section, and then respectively pass through the guide sliding portions 25 of the two rotating members 20 and then tied to the two guide sliders 27. Then, let the other ends of the two lift cords 81 of any one of the lift cord set 8 pierce the respective cord holes 200 of the headrail 2 in sequence, and connect them to the plural slats 61 of the blind body 6 respectively, and then fix them to the bottom rail 7. Preferably, between the two lift cords 81 of any lift cord set 8 and any one of the slats 61 of the blind body 6, a slat fixing rope 83 is wrapped behind the short side of the slat 61.

In addition, any of the tilt cord sets 9 is composed of two tilt cords 91. Let the respective one ends of the two tilt cords 91 respectively pass through the tilt cord holes 151 of the third accommodating portions 15 of the bases 10. Then, each extends upwards along the groove 312 of the cord guide portion 311 of the large-diameter end 31 of the respective tilt member 30. Until the one ends of the two tilt cords 91 pass through the two cord-tying portions 313 of the large-diameter ends 31 of the tilt members 30 respectively, they are then tied to the locking section 3135 of the respective cord-tying portions 313. Then, let the other ends of the two tilt cords 91 of any one of the tilt cord sets 9 be respectively pierced with the cord holes 200 of the headrail 2 and connected to the two lift cords 81 of the respective lift cord set 8 by a plurality of connecting cords 93 respectively, and then fixed to the bottom rail 7. Preferably, connecting cords 93 are arranged at intervals between any tilt cord 91 and any lift cord 81. The connecting cord 93 of any tilt cord set 9 is close to the position of the slat fixing rope 83 of the lift cord set 8. In this way, by the technical feature of providing a plurality of connecting cords 93 between any one of the lift cord sets 8 and any one of the tilt cord sets 9, and the technical feature that the connecting cord 93 of any tilt cord set 9 is close to the position of the slat fixing rope 83 of the lift cord set 8, it will allow the blind body 6 to obtain a nearly synchronized and stable clockwise or counterclockwise flipping effect between any of the slats 61.

Please refer to FIG. 2, FIG. 3, FIG. 5 to FIG. 11. When the operator wants to collapse the blind body 6 and the bottom rail 7 of the window blind 1 upwards, first press the controller 3 and use the wire 301 to electrically control the micro-control unit 51 of the pivoting member 5, so that the micro-control unit 51 of the pivoting member 5 generates a close signal that makes the pivoting member 5 drive the rotating rod 4 to rotate (This embodiment exemplifies that when the axis of the rotating rod 4 rotates clockwise, it is defined as the blind body 6 and the bottom rail 7 of the window blind 1 are in an upwardly folded state). The rotating members 20 and the tilt members 30 of the two cord winding assemblies 100 are driven by the rotation of the pivoting member 5 to drive the rotating rod 4 to rotate accordingly, so that the lift cords 81 of the two lift cord sets 8 are respectively gradually wound on the outer peripheral walls 201 of the two rotating members 20. At the same time, the tilt members 30 are also rotated clockwise with the axial of the rotating rod 4, so that the two tilt cord s 91 of cord sets 9 that are fixed to the locking sections 3135 of the cord-tying portions 313 of the tilt members 30 also rotate clockwise in synchronization with the axial direction of the rotating rod 4. Through the plural connecting cords 93 of the tilt cord sets 9 to indirectly drive the slat fixing ropes 83 of the lift cord sets 8 to turn clockwise, the plural slats 61 of the blind body 6 are tilted clockwise. Until the retaining wall 333 of one of the small-diameter ends 33 of the tilt members 30 is blocked at the protrusion 153 of the third accommodating portion 15 of the base 10, the tilt members 30 no longer continue to show a clockwise turning movement in the axial direction that matches the rotating rod 4, so as to achieve the effect of stopping the turning of the plural slats 61 of the blind body 6. In addition, because of the technical feature that the wire guide section 22 on the outer peripheral wall 201 of each rotating member 20 gradually converges from the large-diameter end 21 to the small-diameter end 23, as the lift cords 81 of the two lift cord sets 8 are wound on the outer peripheral walls 201 of the rotating members 20, the number of turns gradually increases, and the several cord segments wound on the wire guide section 22 of any rotating member 20 are smoothened in direction toward the small-diameter end 23. In this way, a force sufficient to push the guide slider 27 located in the guide sliding portion 25 of any rotating member 20 to slide toward the small-diameter end 23 is gradually generated. It increases the margin that the lift cords 81 of the two lift cord sets 8 can be separately wound on the outer peripheral wall 201 of the rotating member 20. At this time, because the bottom rail 7 is tied to the other ends of the lift cords 81 of the two lift cord sets 8, the bottom rail 7 can drive the plural slats 61 of the blind body 6 gradually close in the direction of the headrail 2. Until the operator presses the controller 3 again and stops the pivoting member 5 from rotating, the rotating members 20 and the tilt members 30 of the two cord winding assemblies 100 will no longer be rotated by the rotating rod 4, and then it achieves the effect of folding the plural slats 61 of the blind body 6.

Please refer to FIG. 1 to FIG. 10 together. When the operator wants to expand the blind body 6 and the bottom rail 7 of the window blind 1 downwards, after pressing the controller 3 again and electrically controlling the micro-control unit 51 of the pivoting member 5 through the wire 301, the micro-control unit 51 of the pivoting member 5 generates an unfolding signal to cause the pivoting member 5 to drive the rotating rod 4 start turning again (this embodiment exemplifies that when the axis of the rotating rod 4 rotates counterclockwise, it is defined as the blind body 6 and the bottom rail 7 of the window blind 1 are in a downward unfolded state). The rotating members 20 and the tilt members 30 of the two cord winding assemblies 100 are all rotated by the pivoting member 5 and drive the rotating rod 4 to rotate accordingly. At this time, make the tilt members 30 rotate counterclockwise with the axis of the rotating rod 4 again. It lets one retaining wall 333 of the small-diameter ends 33 of the tilt members 30 that originally blocked on the protrusion 153 of the third accommodating portion 15 of the base 10 cooperate with the rotating rod 4 to rotate accordingly. The two tilt cords 91 of the tilt cord set 9 that were retained to the locking sections 3135 of the cord-tying portions 313 of the cord-tying portions 313 of the tilt members 30 also rotate counterclockwise almost synchronously with the axial direction of the rotating rod 4. The plural connecting cords 93 of the tilt cord sets 9 indirectly drive the slat fixing ropes 83 of the lift cord sets 8 to turn toward the initial direction, and the plural slats 61 of the blind body 6 also turn toward the initial counterclockwise direction. Until the other retaining wall 333 of the small-diameter ends 33 of the tilt members 30 is blocked again at the protrusion 153 of the third accommodating portion 15 of the base 10, the tilt members 30 no longer continue to rotate counterclockwise in the axial direction of the rotating rod 4, thereby achieving the effect of stopping the turning of the plural slats 61 of the blind body 6. At this time, because the cord segments of the two lift cord sets 8 originally wound on the outer peripheral walls 201 of the rotating members 20 are gradually released, the other ends of the two lift cord sets 8 can be stretched by the bottom rail 7 again and can move downwards away from the bottom of the headrail 2. At this time, the guide sliders 27 of the rotating members 20 of the two cord winding assemblies 100 are respectively made to move from the small-diameter end 23 of the rotating member 20 to the initial direction of the large-diameter end 21, and the blind body 6 matches the predetermined length stretched by the other ends of the two lift cord sets 8 to present an unfolded state again. Until the operator presses the controller 3 again and electrically controls the micro-control unit 51 of the pivoting member 5 through the wire 301, the micro-control unit 51 of the pivoting member 5 generates a stop signal to stop the pivoting member 5. The rotating members 20 and the tilt members 30 of the two cord winding assemblies 100 will no longer be rotated by the rotating rod 4 in the counterclockwise direction, so that the blind body 6 is expanded. Preferably, the turning control unit 53 of the pivoting member 5 can generate a turning signal to cause the tilt members 30 of the two cord winding assemblies 100 to tilt clockwise or counterclockwise again, indirectly driving the plural slats 61 of the blind body 6 through the tilt cord sets 9 to produce clockwise or counterclockwise tilting, so as to achieve the effect of adjusting the light source.

Figure 5:
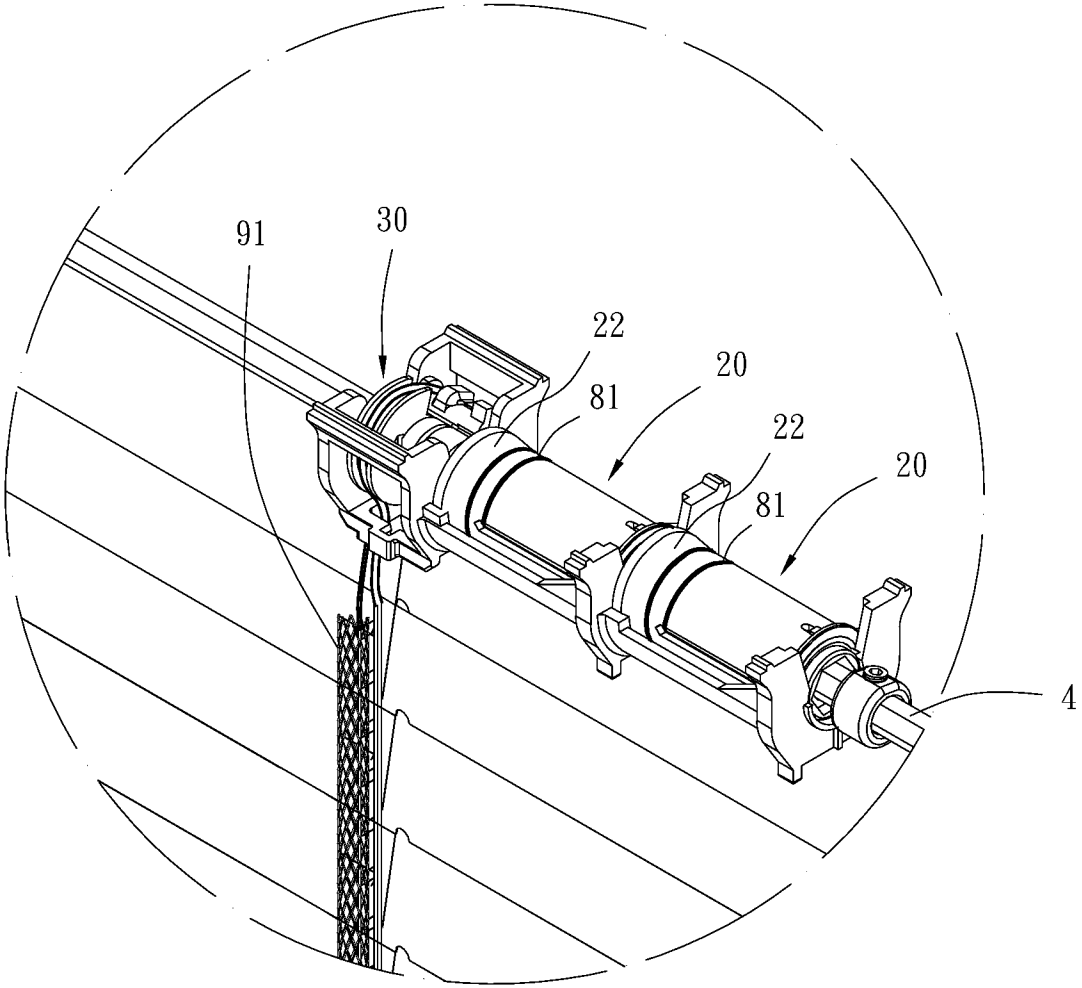
FIG. 5 is an enlarged and three-dimensional schematic diagram of part of the components of FIG. 1, which mainly reveals the relative relationship between a lift cord set and a tilt cord set of the window blind.
Figure 6:
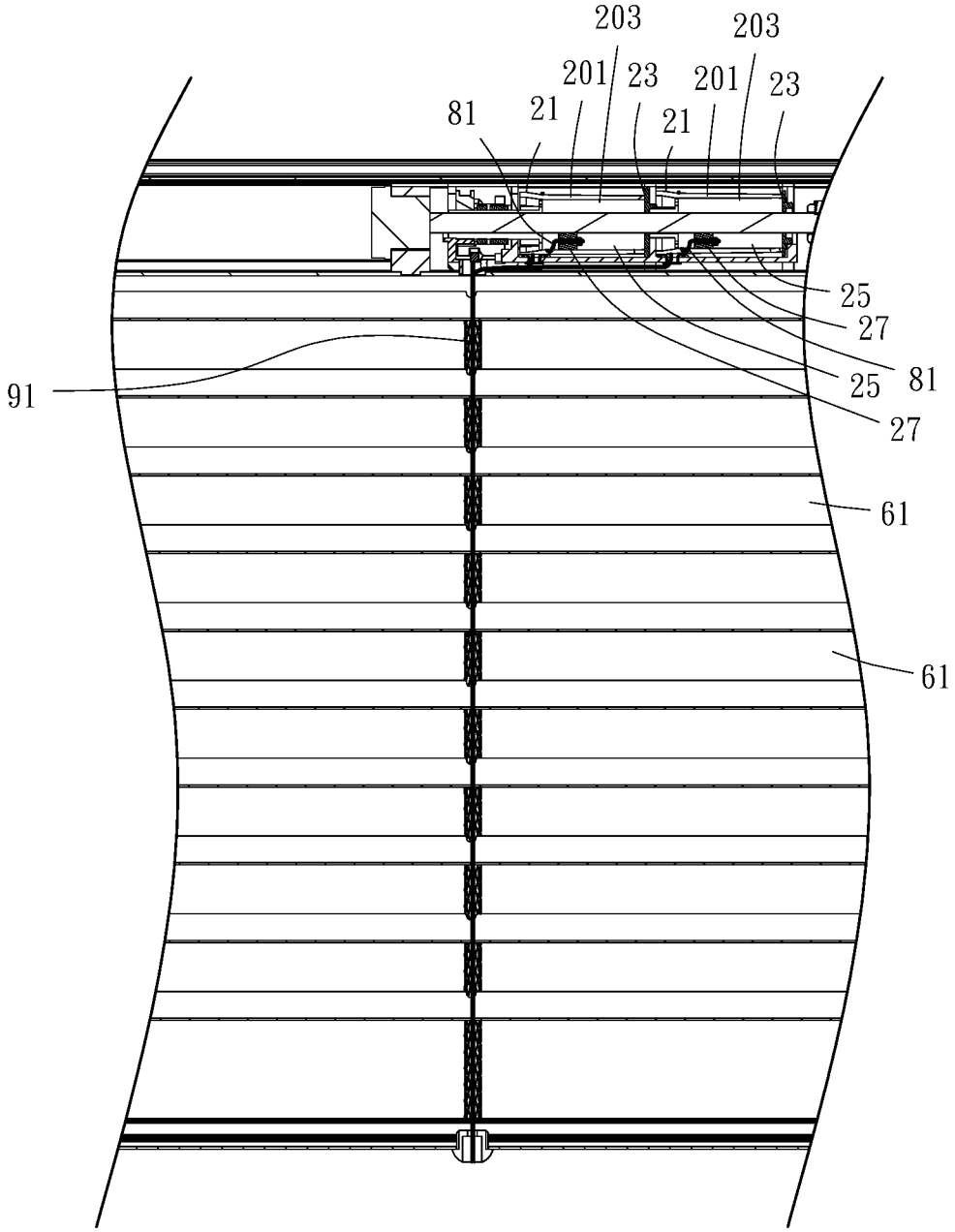
FIG. 6 is a schematic cross-sectional view of some of the components of FIG. 1.
Figure 7:
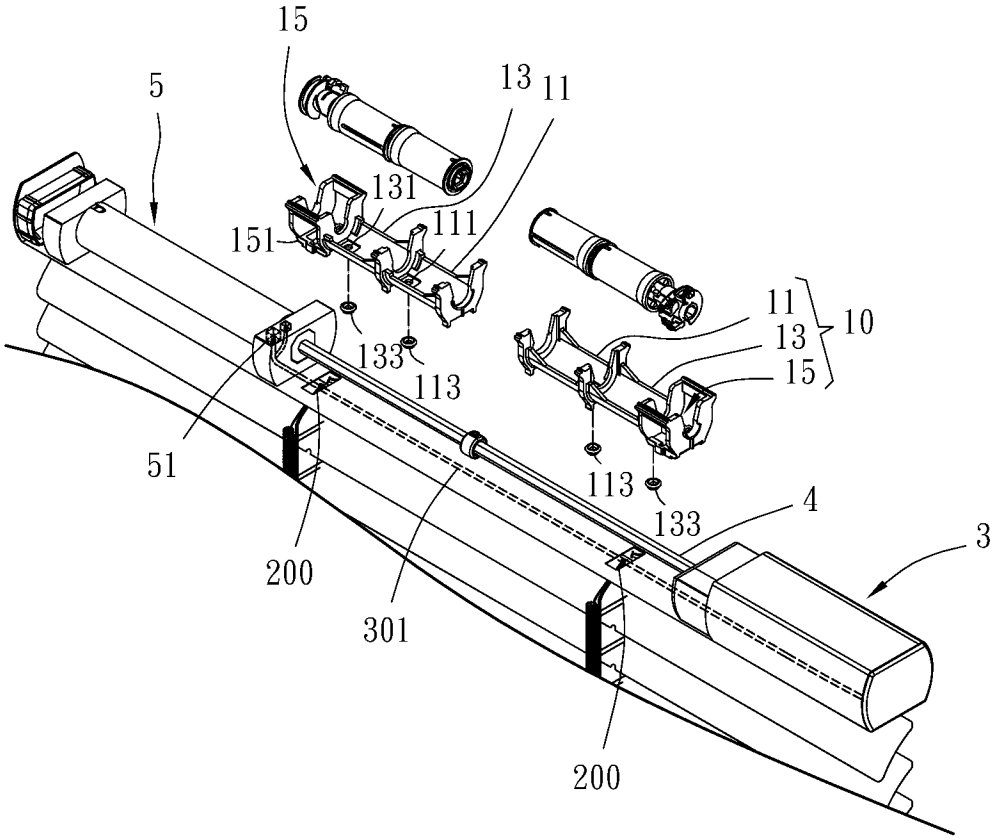
FIG. 7 is an exploded and three-dimensional schematic diagram of part of the components of FIG. 1.
Figure 8:
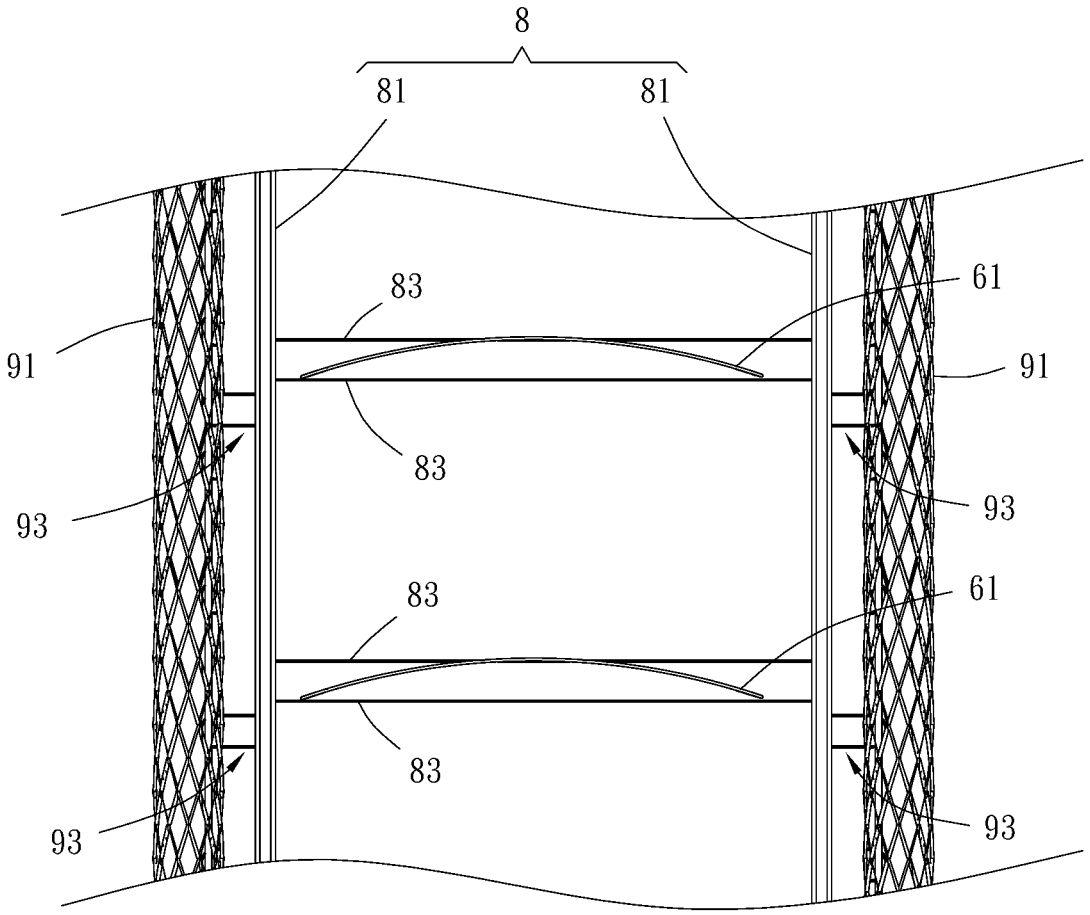
FIG. 8 is an enlarged and side view schematic diagram of part of the components of FIG. 1, mainly exposing the blind body of the window blind, the relative relationship between the lift cord sets and the tilt cord sets.
Figure 9:
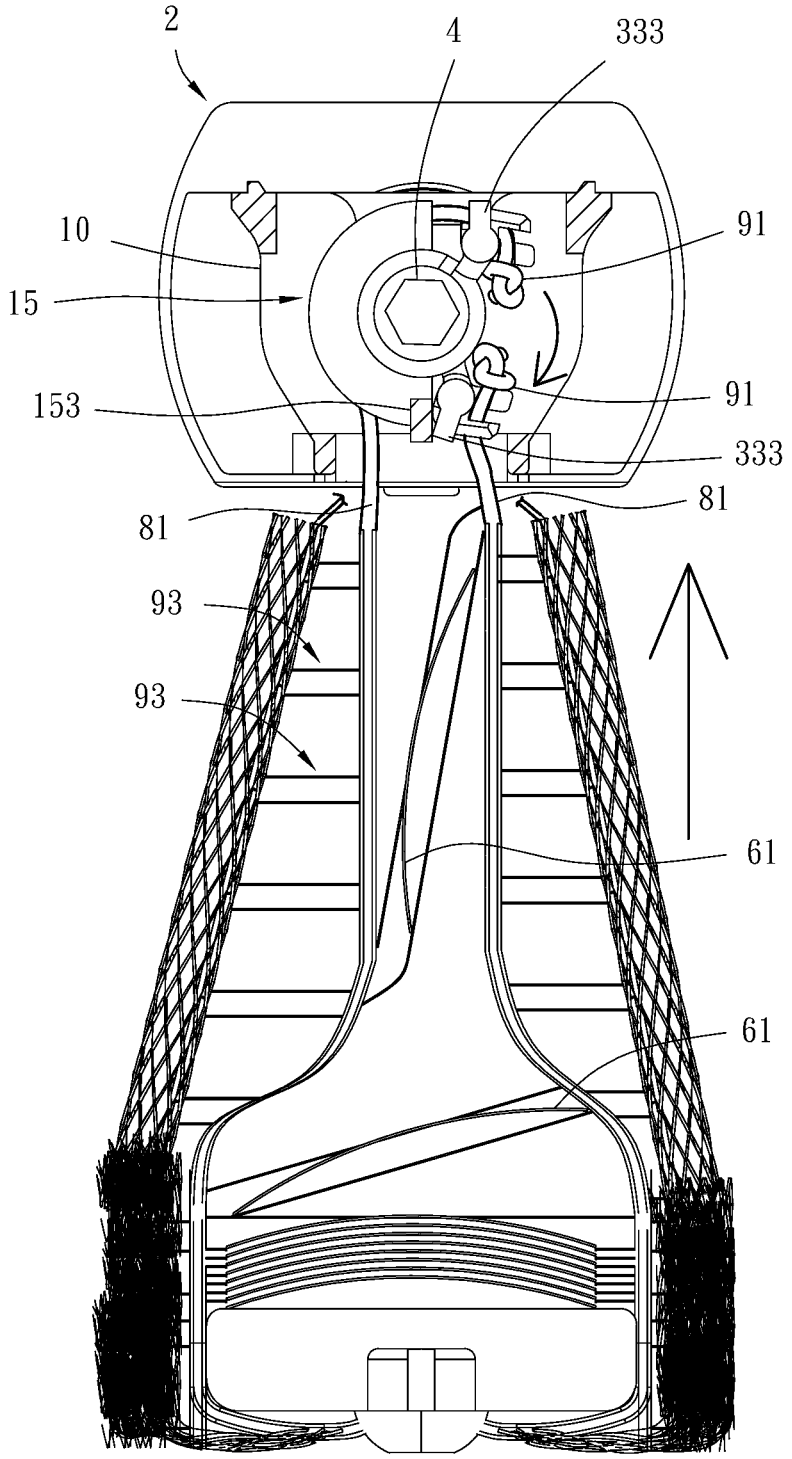
FIG. 9 is a schematic cross-sectional view of some of the components of FIG. 3.
Figure 10:
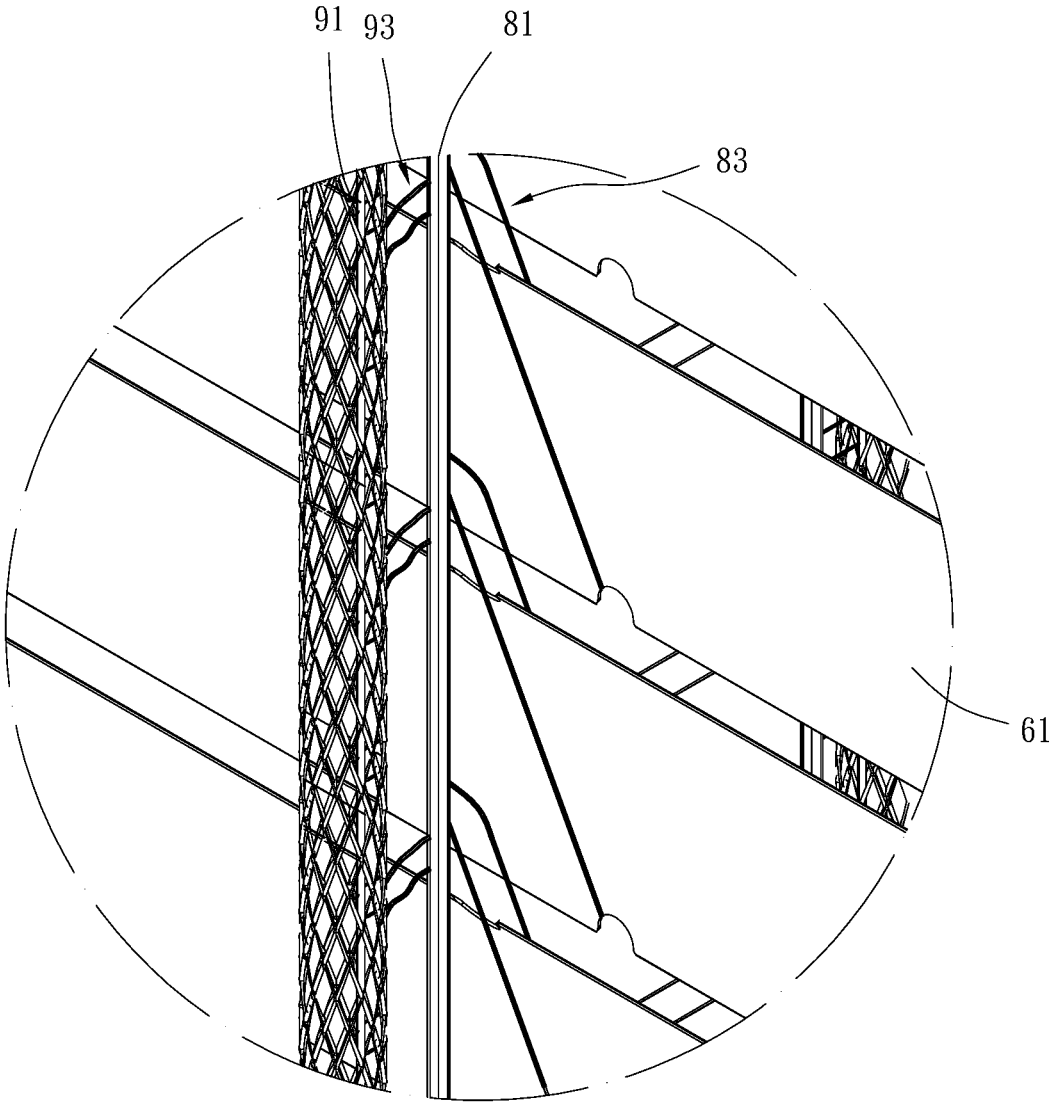
FIG. 10 is an enlarged schematic diagram of part of the components of FIG. 2.
Figure 11:
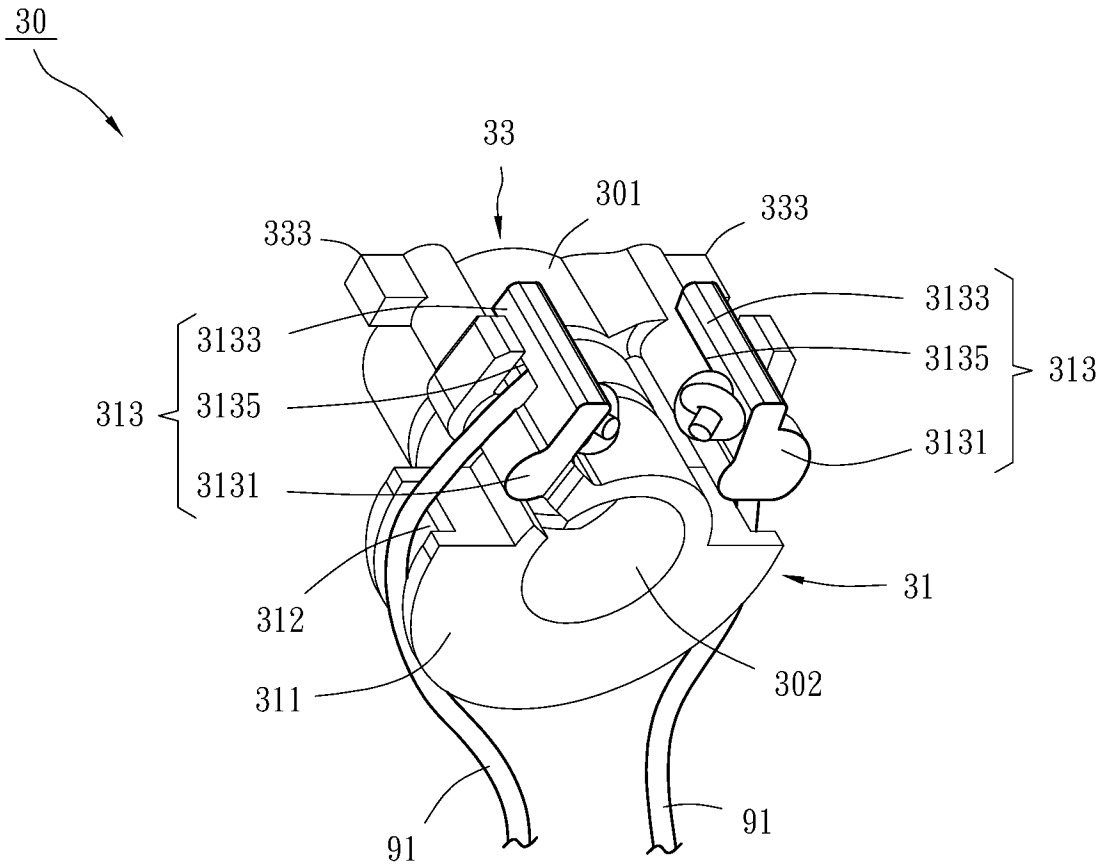
FIG. 11 is an enlarged and three-dimensional schematic diagram of part of the components of FIG. 1, mainly exposing the connection relationship between the tilt member and the tilt cord set of the window blind.
Figure 12:
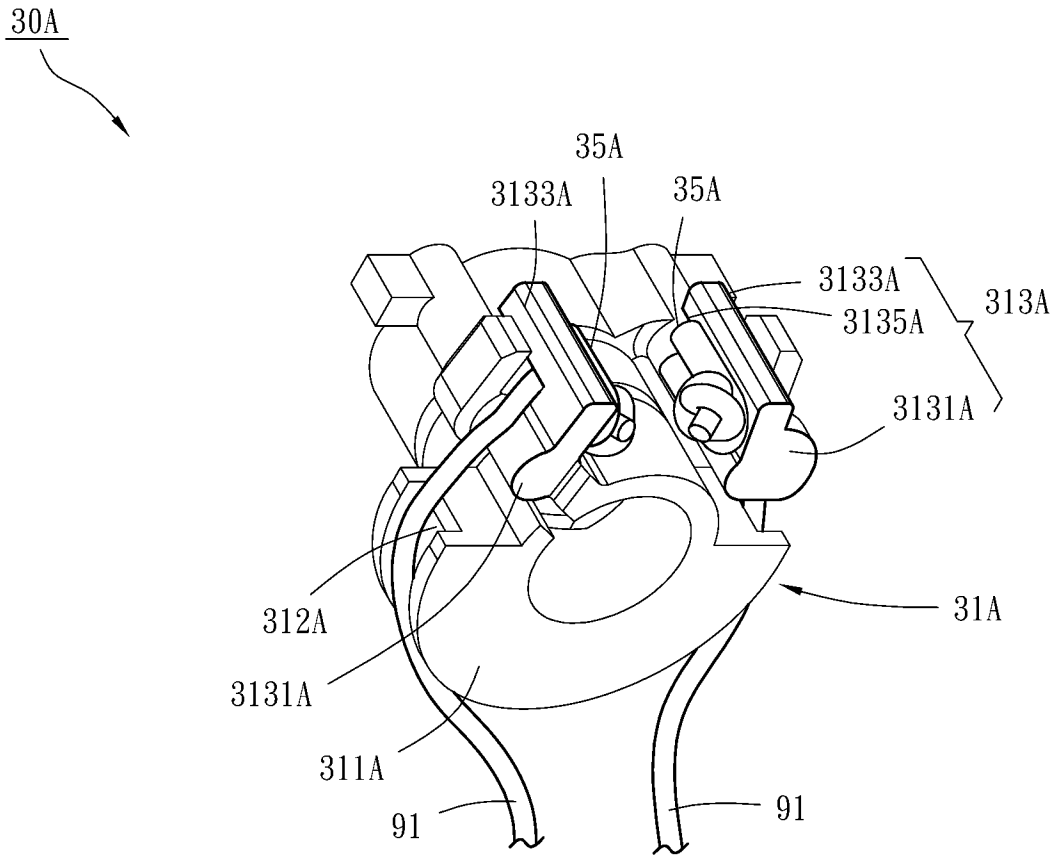
FIG. 12 is similar to the enlarged and three-dimensional schematic diagram of some components of FIG. 11, mainly exposing the connection relationship between an alternate form of the tilt member of the window blind and the tilt cord set.

Please refer to FIG. 1, FIG. 5 and FIG. 12, another design of hollow winding tilt member 30A suitable for the two cord winding assemblies 100 of the window blind 1 disclosed in the preferred embodiment of the present invention is shown. Its main structure and technical features, operating methods during use, and its intended effects are all similar to those of the previously disclosed preferred embodiment. The large-diameter end 31A of the tilt member 30A has a semi-circular cord guide portion 311A and two cord-tying portions 313A arranged at intervals, and the outer periphery of the cord guide portion 311A is radially recessed to form a groove 312A, and any cord-tying portion 313A is composed of a connecting section 3131A connected to a limiting section 3133A, so that a locking section 3135A is formed between the connecting section 3131A and the limiting section 3133A. The difference is that the tilt member 30A is equipped with two U-shaped clips 35A. One end of each of the two tilt cords 91 of any one of the tilt cord sets 9 respectively extends upwards along the groove 312A of the cord guide portion 311A of the large-diameter end 31A of the tilt member 30A, until the respective one ends of the two tilt cord s 91 respectively pass through two cord-tying portions 313A of the large-diameter end 31A of the tilt member 30A and are respectively tied to the two clips 35A. Then, the two clips 35A are respectively locked and fixed at the positions of the locking sections 3135A of the two cord-tying portions 313A.

Figure 13:
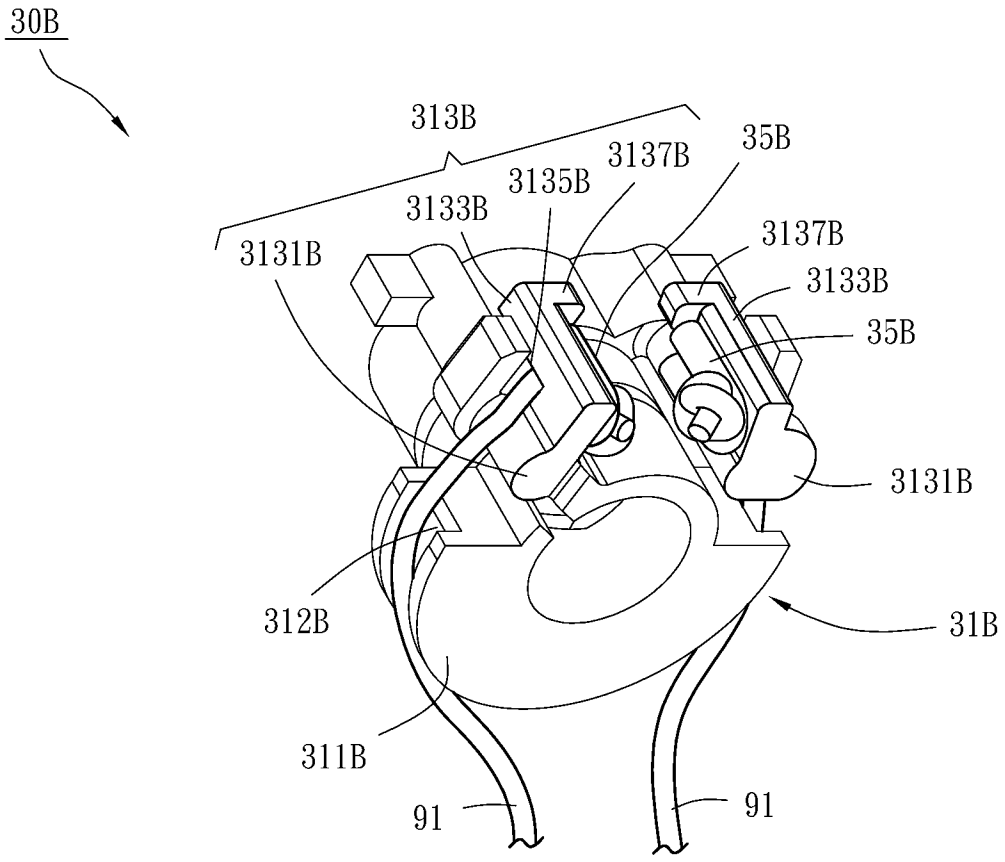
FIG. 13 is similar to the enlarged and three-dimensional schematic diagram of some components of FIG. 12, mainly exposing the connection relationship between another alternate form of the tilt member of the window blind and the tilt cord set.

Please refer to FIG. 1, FIG. 5 and FIG. 13, still another design of hollow winding tilt member 30B suitable for the two cord winding assemblies 100 of the window blind 1 disclosed in the preferred embodiment of the present invention is shown. Its main structure and technical features, operating methods during use, and its intended effects are all similar to those of the previously disclosed preferred embodiment. The large-diameter end 31B of the tilt member 30B has a semi-circular cord guide portion 311B and two cord-tying portions 313B arranged at intervals, and the outer periphery of the cord guide portion 311B is radially recessed to forma groove 312B, and any cord-tying portion 313B is composed of a connecting section 3131B connected to a limiting section 3133B, so that a locking section 3135B is formed between the connecting section 3131B and the limiting section 3133B. The difference is that the end of the limiting section 3133B of any cord-tying portion 313B protrudes relatively to form a blocking section 3137B, and the tilt member 30B is provided with two U-shaped clips 35B. The respective one ends of the two tilt cords 91 of any one of the tilt cord set 9 respectively extend upwards along the groove 312B of the cord guide portion 311B of the large-diameter end 31B of the tilt member 30B, until the respective one ends of the two tilt cords 91 are respectively passed through the two cord-tying portions 313B of the large-diameter end 31B of the tilt member 30B, they are then tied to the two clips 35B respectively. The two clips 35B are respectively locked and fixed at the positions of the locking sections 3135B of the two cord-tying portions 313B, and the two clips 35B are respectively restricted and blocked in the blocking sections 3137B of the two cord-tying portions 313B to prevent the two clips 35B from detaching.

What is claimed is:

1. A cord winding assembly, comprising:

a base comprising a first accommodating portion, a second accommodating portion and a third accommodating portion, said first accommodating portion having a cord hole penetrated through a bottom thereof, said second accommodating portion having a cord hole penetrated through a bottom thereof, said third accommodating portion having a tilt cord hole penetrated through a bottom thereof and being provided with a protrusion, said second accommodating portion being located between said first accommodating portion and said third accommodating portion;

two rotating members, each said rotating member being a hollow tube body and forming an outer peripheral wall and an inner peripheral wall, said outer peripheral wall of each said rotating member comprising a large-diameter end, a wire guide section and a small-diameter end, said large-diameter end and said small-diameter end of each said rotating member being respectively pivoted on said first accommodating portion and said second accommodating portion of said base, said wire guide section surrounding said outer peripheral wall of said rotating member and being connected to said large-diameter end, said wire guide section converging from said large-diameter end to said small-diameter end, said outer peripheral wall of each said rotating member being recessed in the direction of said inner peripheral wall to form a guide sliding portion, each said rotating member being provided with a guide slider, said guide slider being pivotally set on the associating said guide sliding portion; and a tilt member, comprising a large-diameter end and a small-diameter end respectively formed at two opposite ends thereof, said large-diameter end comprising a cord guide portion and two cord-tying portions arranged at intervals and a groove radially recessed from the outer periphery of said cord guide portion, each said cord-tying portion being composed of a connecting section and a limiting section, so that a locking section is formed between said connecting section and said limiting section, said small-diameter end comprising two retaining walls located on an outer periphery thereof, said tilt member being pivotally connected to said third accommodating portion of said base, wherein, said two retaining walls of said small-diameter end of said tilt member being blocked by said protrusion of said third accommodating portion of the base after a predetermined pivot.

2. A window blind, comprising a headrail, a controller, a rotating rod, a pivoting member, a blind body, a bottom rail, two lift cord sets, two tilt cord sets and two cord winding assemblies as claimed in claim 1, said controller being installed on one side of said headrail, said rotating rod, said pivoting member and said two cord winding assemblies being all set on said headrail, said controller being electrically connected to a micro-control unit of said pivoting member, so that said pivoting member is electrically controlled by said micro-control unit, said rotating rod having one end thereof connected to said pivoting member and pivoted by said pivoting member to produce movement and an opposite end thereof passed through said rotating members and said tilt members of said two cord winding assemblies, said blind body comprising a plurality of slats, said blind body having one side thereof connected to said headrail and an opposite side thereof connected to said bottom rail, said lift cord sets having respective one ends thereof respectively set on said rotating members of said cord winding assemblies and respective opposite ends thereof respectively inserted through a respective perforation of said headrail and connected with said slats of said blind body and then fixed to said bottom rail, said tilt cord sets having respective one ends thereof respectively tied to said tilt members of said cord winding assemblies and respective opposite ends thereof respectively inserted through the respective said perforations of said headrail and connected with said slats of said blind body and then fixed to said bottom rail.

3. The window blind as claimed in claim 2, wherein each said lift cord set comprises two lift cords, each said lift cords having respective one ends thereof respectively inserted through said cord hole of said first accommodating portion and said cord hole of said second accommodating portion of said base and respectively wound on said outer peripheral walls of said rotating members at least one circle to form a reserved section, and then passed through said guide sliding portions of said rotating members and then respective tied to said guide sliders, said lift cords having respective opposite ends thereof respectively pierced through said cord holes of said headrail and respectively connected to two opposite long sides of said slats of said blind body and then fixed to said bottom rail.

4. The window blind as claimed in claim 3, wherein between the two lift cords of each said lift cord set and each said slat of said blind body, a slat fixing rope is used to surround the short side of each said slat and then individually connected and fixed to said lift cords.

5. The window blind as claimed in claim 4, wherein each said tilt cord set comprises two tilt cords, said tilt cords having respective one ends thereof respectively pass through said tilt cord holes of said third accommodating portions of said bases of said cord winding assemblies, and then, each extending upwards along said groove of said cord guide portion of said large-diameter end of the respective said tilt member, and then respectively passing through said cord-tying portions of said large-diameter ends of said tilt members, and then tied to said locking section of the respective said cord-tying portions, said tilt cords having respective one ends thereof respectively pierced with said cord holes of the headrail and respectively connected to said lift cords of the respective said lift cord sets by a plurality of connecting cords, and then fixed to said bottom rail.

6. The window blind as claimed in claim 5, wherein said tilt cord set comprises a plurality of connecting cords, said connecting cords being arranged at intervals between each said tilt cord and each said lift cord, each said connecting cord of said tilt cord set being close to the position of said slat fixing rope of said lift cord set.

7. The window blind as claimed in claim 6, wherein said tilt member is further provided with two clips, which are respectively blocked in said blocking sections of said two cord-tying portions.

8. The window blind as claimed in claim 7, wherein one end of each of said two tilt cords of each said tilt cord set respectively extends upwards along said groove of said cord guide portion of said large-diameter end of said tilt member, and is then inserted through said cord-tying portions of said large-diameter end of the respective said tilt member, and then respectively tied to one respective said clip, so that said two clips are respectively locked and fixed at the positions of said locking sections of said two cord-tying portions, and said two clips are respectively restricted and blocked in said blocking sections of said two cord-tying portions.

* * * * *